US008657533B2

(12) United States Patent
Foote

(10) Patent No.: US 8,657,533 B2
(45) **Date of Patent: *Feb. 25, 2014**

(54) GRAVITY BASE STRUCTURE

(75) Inventor: Bernard Foote, Guildford (GB)

(73) Assignee: Ausenco Canada Inc., Vancouver, B.C. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/368,210

(22) Filed: Feb. 7, 2012

(65) Prior Publication Data

US 2012/0201609 A1 Aug. 9, 2012

Related U.S. Application Data

(60) Provisional application No. 61/441,245, filed on Feb. 9, 2011.

(51) Int. Cl.
*B63B 35/40* (2006.01)

(52) U.S. Cl.
USPC ..... 405/207; 405/203; 405/205; 405/195.1

(58) Field of Classification Search
USPC ..... 405/195.1, 203–208
See application file for complete search history.

(56) References Cited

U.S. PATENT DOCUMENTS

| | | | | | |
|---|---|---|---|---|---|
| 2,938,352 | A | * | 5/1960 | Knapp et al. | 405/207 |
| 3,727,414 | A | * | 4/1973 | Davies | 405/196 |
| 3,729,940 | A | * | 5/1973 | Koehler | 405/205 |
| 4,018,057 | A | * | 4/1977 | Erzen et al. | 405/25 |
| RE29,478 | E | * | 11/1977 | Goren et al. | 114/265 |
| 4,257,718 | A | * | 3/1981 | Rosa et al. | 405/167 |
| 4,380,406 | A | * | 4/1983 | Ayers | 405/206 |
| 4,451,174 | A | * | 5/1984 | Wetmore | 405/196 |
| 4,479,742 | A | | 10/1984 | Bruce | |
| 4,629,365 | A | * | 12/1986 | Kuriiwa | 405/204 |
| 4,639,167 | A | | 1/1987 | Petty et al. | |
| 4,648,750 | A | * | 3/1987 | Horton | 405/208 |
| 4,808,036 | A | | 2/1989 | Bhalaik et al. | |
| 5,316,413 | A | | 5/1994 | Sisodiya et al. | |
| 5,383,748 | A | | 1/1995 | Waddell | |

(Continued)

FOREIGN PATENT DOCUMENTS

| | | | | |
|---|---|---|---|---|
| EP | 39590 A2 | * | 11/1981 | E02B 17/02 |
| RU | 2235183 C1 | | 8/2004 | |
| SU | 1553016 A3 | | 3/1990 | |

OTHER PUBLICATIONS

Russian Office Action dated Jun. 24, 2013, issued by the Russian Intellectual Property Federal Service in corresponding Russian Patent Application No. 2012104216/03(006350), filed Aug. 2, 2012.

(Continued)

*Primary Examiner* — Thomas B Will
*Assistant Examiner* — Jessica H Lutz
(74) *Attorney, Agent, or Firm* — Klarquist Sparkman, LLP

(57) ABSTRACT

Embodiments of gravity base structures are disclosed that comprise first and second elongated base sections separated by an open region and configured to support the on-bottom weight of the structure and be supported by the floor of the body of water, and an upper section positioned above the open region and configured to extend at least partially above the water surface to support topside structures. Some embodiments further comprise first and second inclined sections coupling the base sections to the upper section.

20 Claims, 7 Drawing Sheets

(56) References Cited

U.S. PATENT DOCUMENTS

| | | | | |
|---|---|---|---|---|
| 5,593,250 | A * | 1/1997 | Smith et al. | 405/205 |
| 5,613,808 | A | 3/1997 | Fitzpatrick | |
| 5,775,846 | A | 7/1998 | Blandford et al. | |
| 6,203,248 | B1 * | 3/2001 | Childers et al. | 405/227 |
| 6,447,208 | B1 | 9/2002 | Huang et al. | |
| 6,736,571 | B2 * | 5/2004 | McCarthy et al. | 405/209 |
| 6,761,124 | B1 | 7/2004 | Srinivasan | |
| 7,140,317 | B2 | 11/2006 | Wybro et al. | |
| 7,530,780 | B2 * | 5/2009 | Kothnur et al. | 415/4.3 |
| 2003/0108392 | A1 * | 6/2003 | McCarthy et al. | 405/196 |
| 2006/0275080 | A1 | 12/2006 | Li et al. | |
| 2009/0035069 | A1 | 2/2009 | Krehbiel et al. | |
| 2010/0221069 | A1 | 9/2010 | Brinkmann et al. | |

OTHER PUBLICATIONS

English language translation of Russian Office Action of Jun. 24, 2013.

* cited by examiner

GRAVITY BASE STRUCTURE

CROSS-REFERENCE TO RELATED APPLICATION

This application claims the benefit of U.S. Provisional Patent Application No. 61/441,245 filed Feb. 9, 2011, which is incorporated herein in its entirety.

FIELD

This disclosure is related to gravity base structures, such as for supporting hydrocarbon drilling and extraction facilities in deep arctic seas.

BACKGROUND

Deepwater gravity base structure (GBS) concepts for regions experiencing significant sea ice have traditionally been based on large monolithic steel or concrete substructures supporting offshore hydrocarbon drilling or production facilities. In deeper waters, the size, weight and cost of these structures pose major challenges in terms of design, construction, and installation. Traditional GBS designs generally rely on a monolithic caisson, with or without discrete vertical legs, filled largely with sea water and/or solid ballast to resist horizontal loads from ice and wave interaction. The caisson gross volume and minimum required on bottom weight increase rapidly with water depth and horizontal load. This can lead to difficulty in satisfying the foundation design requirements, especially in weaker cohesive soils.

SUMMARY

Embodiments of open gravity base structures for use in deep arctic waters are disclosed that comprise wide set first and second elongated base sections separated by an open region and configured to support the on-bottom weight of the structure and be supported by the floor of the body of water. An upper caisson section can be positioned above the open region and configured to extend at least partially above the water surface to support topside structures. Some embodiments further comprise first and second inclined strut sections coupling the wide set base sections to the upper section.

The foregoing and other objects, features, and advantages of embodiments disclosed herein will become more apparent from the following detailed description, which proceeds with reference to the accompanying figures.

DETAILED DESCRIPTION

Exemplary Embodiments

Described here are embodiments of gravity base structures (GBS) that significantly reduce the substructure weight required for a given water depth while offering considerable advantages in constructability, transportation and installation. The disclosed embodiments can be used to support drilling or production facilities in water depths of up to 200 meters or more. Some embodiments can support topside facilities with large installation weights, such as from about 30,000 tonnes to about 90,000 tonnes, or more. Some embodiments have the capability to withstand ice, water, and soil conditions typical of the arctic and sub-arctic seas, such as in the Beaufort Sea and the Kara Sea.

The embodiments disclosed herein can reduce the traditional conflict between bearing load, buoyancy, and footprint area by supporting the topsides on widely separated base sections and support struts. These large base sections and support struts can provide manufacturing and construction efficiencies due to modular designs. Components can also be symmetric to increase manufacturing efficiency.

Figure 1:
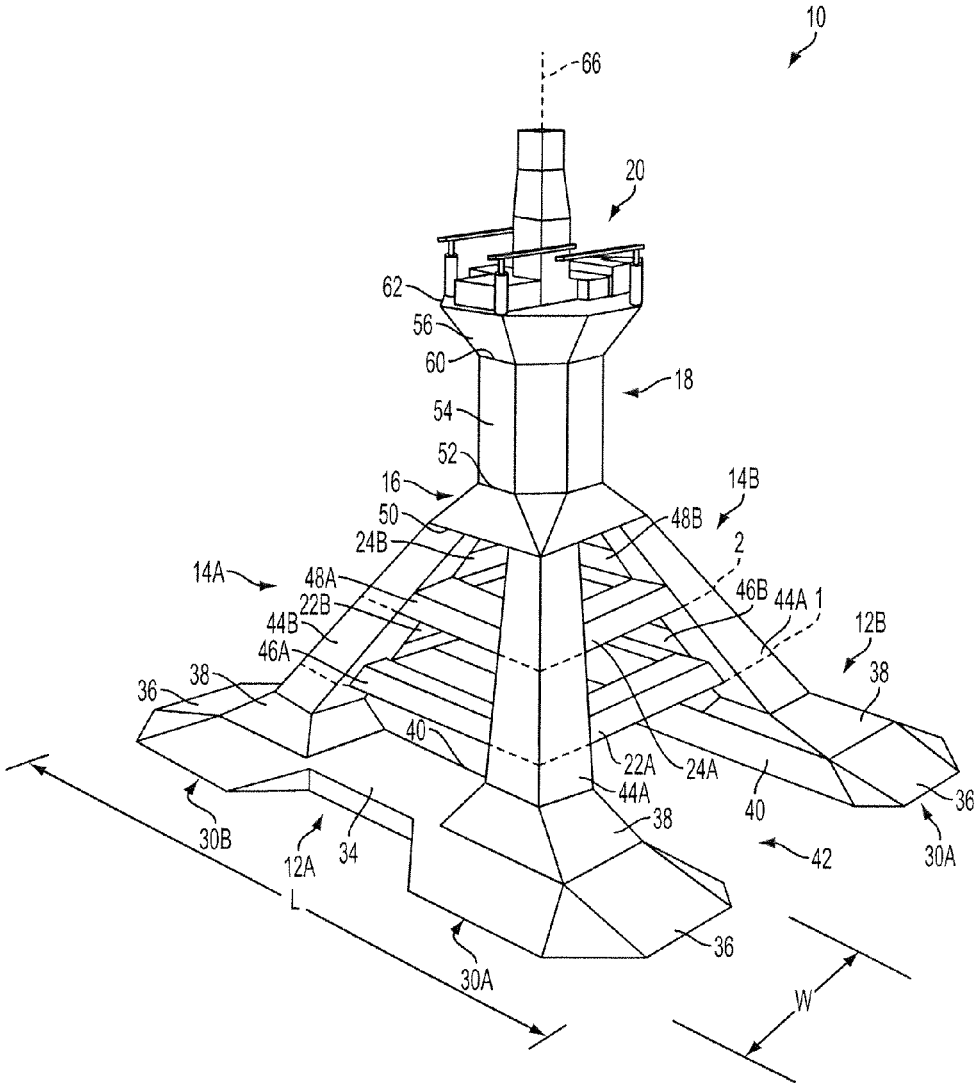
FIG. 1 illustrates an exemplary embodiment of a gravity base structure with two separated base sections.

FIGS. 1 and 2 show an exemplary embodiment of a GBS 10 comprising a first base section 12A and a second base section 12B, a first inclined section 14A, a second inclined section 14B, a transition section 16, and an upper section 18, and can support a topside section 20. Some embodiments of the GBS 10 can further comprise one or more cross ties extending between the inclined sections 14, such as spaced apart cross ties 22A and 22B and spaced apart cross ties 24A and 24B.

Each of the base sections 12 can be configured to be supported on a seabed and can support the rest of the GBS 10. The base sections 12 can each comprise a first foot portion 30A, a second foot portion 30B, and an intermediate portion 34 extending between the first and second foot portions. The base sections 12 can be elongated in the direction between the first and second foot portions 30A, 30B. The foot portions 30 can have a large bottom surface area and can taper in horizontal cross-sectional area moving upward from a base surface across a sloped upper surface. The foot portions 30A, 30B can each comprise a chamfered outer portion 36 that has a gently inclined upper surface, and can comprise an upwardly projecting portion 38 that can have side surfaces that are more steeply inclined than the surface 36. The foot portions 30A, 30B can comprise a plurality of flat, polygonal surfaces, although some embodiments can comprise curved surfaces or other non-flat and/or non-polygonal surfaces.

Figure 2A:
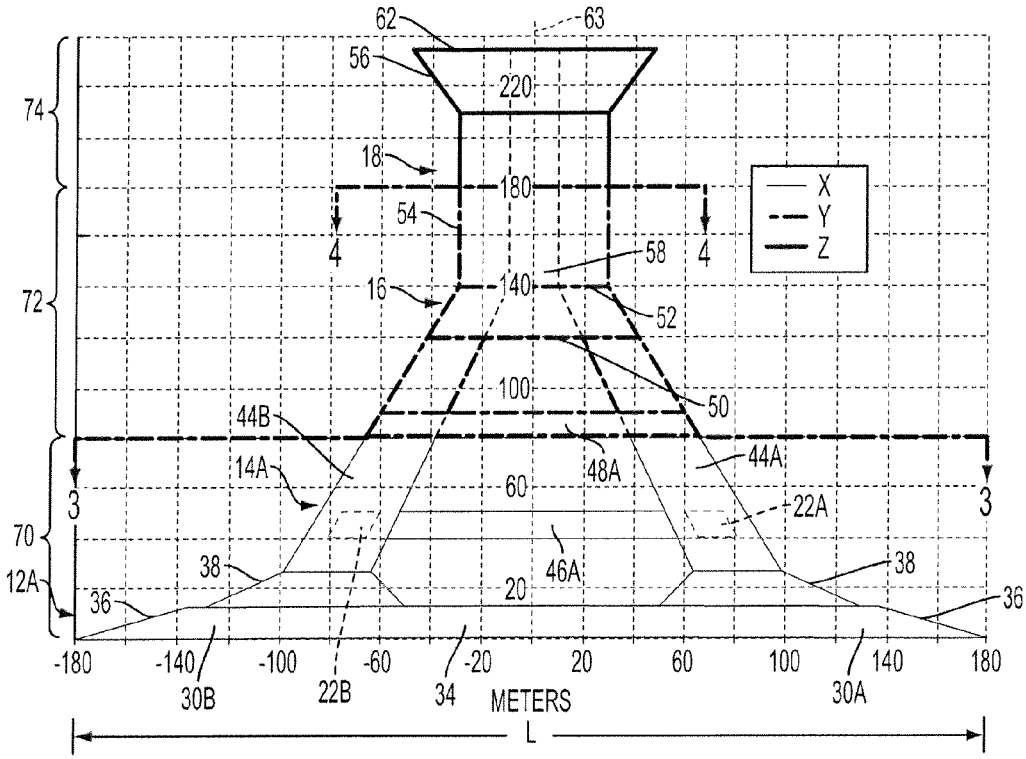
FIG. 2A shows a side profile view of the embodiment of FIG. 1.
Figure 2B:
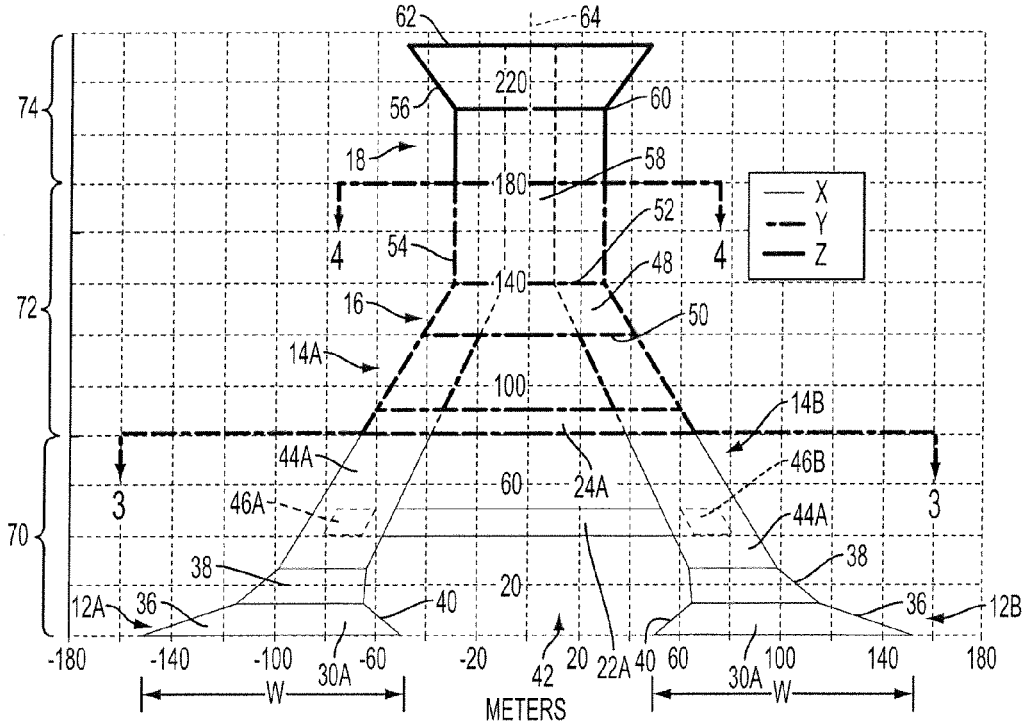
FIG. 2B shows a front end profile view of the embodiment of FIG. 1.

Each of the base sections 12 can have an overall longitudinal length L and an overall width W, as shown in FIG. 1. Each foot portion 30 can have a maximum width of W while the intermediate portion 34 can have a reduced width, creating a neck or intermediate section of reduced width between the two foot portions 30A, 30B. Each of the base sections 12 can have an outer sidewall surface and can have a generally straight inner sidewall surface 40 that extends the full length of the base section 12 across both of the foot portions 30A, 30B and the intermediate portion 34 along the length direction L. Each base section 12 can be generally symmetrical about a first vertical plane 63 (see FIG. 3) cutting through the intermediate portion 34 midway between the foot portions 30. In addition, the base section 12A can be generally symmetrical with the base portion 12B about a second vertical plane 64 (see FIG. 3) extending in the length direction L half way between the two base sections 12. These first and second vertical planes 63, 64 can each generally bisect the entire GBS 10 into respective symmetrical halves on either side of each of the planes, as shown in FIGS. 2A and 2B.

The two base portions 12A and 12B can be widely separated by an open region 42 between the inner sides 40 of the two base sections. The open region 42 can extend the entire length L of the base sections. In embodiments without the cross-ties 22 and 24, the open region can extend upward to the transition section 16 and separate the two inclined sections as well. An embodiment has an "open region" between the two base sections 12A, 12B when the entire region directly between the two base sections 12A, 12B is obstructed by less than 10% of structural components. In some embodiments, the two base sections 12A and 12B can be "completely separated" by the open region 42, meaning that there are no structural components extending directly between the two base sections 12.

Figure 3:
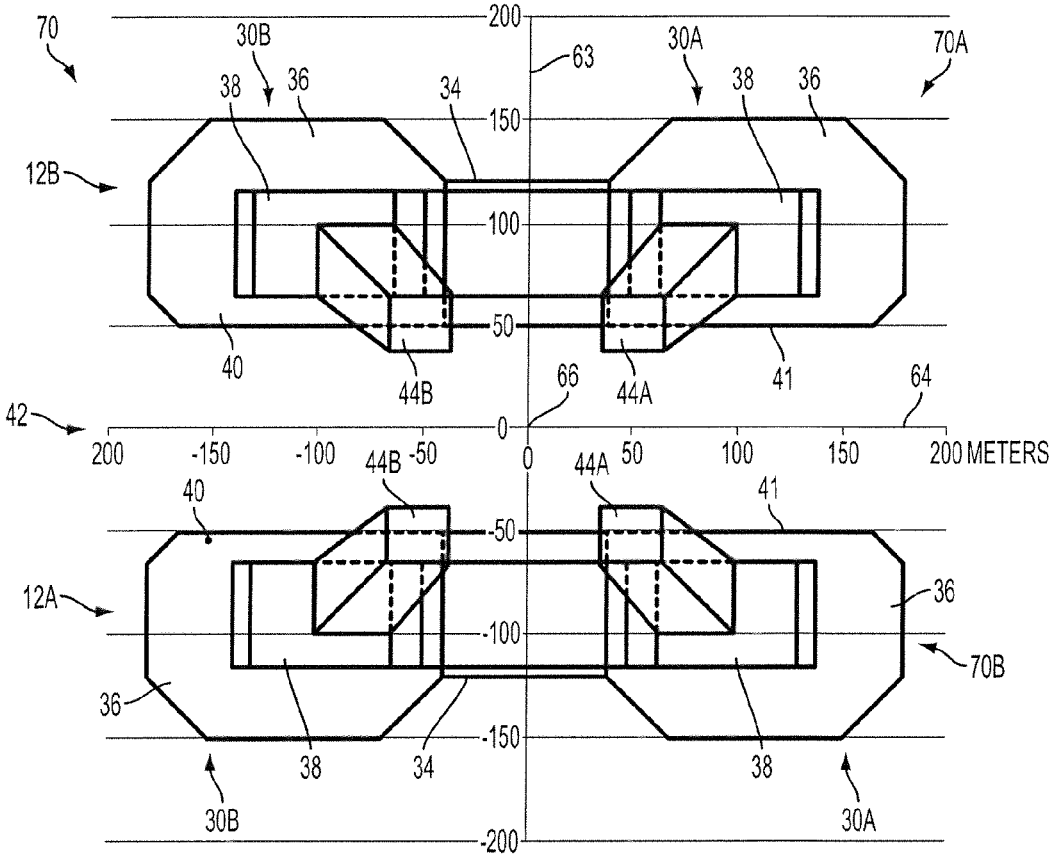
FIG. 3 shows a top plan view of first and second spaced apart base units of an exemplary gravity base structure in the direction of arrows 3-3 of FIGS. 2A and 2B.

Each base section 12A, 12B can comprise a footprint area defined by the perimeter of the bottom surface of the base section that is configured to contact the underlying seabed. Exemplary footprint areas are shown in FIG. 3 by the bolded outer perimeter of the base section 12. The open region 42 between the footprints of the base sections 12 can have an area that is greater than either of the footprint areas, or more than 50% of the total area of the two footprints. In other embodiments, open region 42 between the footprints of the base sections 12 can have an area that is at least 25% of the total area of the two footprints. In some embodiments, each of the footprints can have an area that is greater than the maximum horizontal cross-section area of the upright annular section, or caisson section, 18.

Each of the inclined sections 14A, 14B can extend upwardly from the upper portions 38 of the foot portions 30A, 30B of their associated base sections 12A, 12B to the transition section 16. It should be noted that a stub portion of a corner structure of each of the sections 14A, 14B can be included in the associated base section. The inner portions 14A, 14B can be inclined such that they lean toward one another. The distance between the two inclined portions 14A, 14B can decrease moving from the base sections 12 toward the transition section 16, such that the two inclined portions can be more readily connected together at the transition portion 16. The inclined nature of the inclined sections is best seen in the end view of FIG. 2B. Thus, the side portions 14A, 14B can converge, or at least portions thereof can converge, moving away from their associated base section 12. Desirably they continuously converge moving upwardly. However, they can less desirably have sections that converge with intervening non-converging portions.

Each inclined section 14A, 14B can comprise a first and second strut 44A, 44B and one or more horizontal cross members, such as 46A and 48A for inclined section 14A and 46B and 48B for inclined section 14B, which can be parallel to and spread apart one above the other. One strut 44A is coupled to one foot portion 30A of each base section 12 and the other strut 44B is coupled to the other foot portion 30B of each base section. The struts 44A and 44B of the respective inclined section 14A can converge, in whole or in part toward one another. The struts of section 14B can be arranged in the same manner. Thus, the struts of one section 14A can slant toward one another and toward the struts of the other inclined section 14B and these struts of section 14B can slant toward one another and toward the struts of section 14A. Each strut 44 can have a generally square horizontal cross section that decreases in area with elevation. Other cross sectional configurations can be employed. The four struts 44 can have the same degree of slant and can be generally symmetrical about a vertical central axis 66 of the GBS 10 defined by the intersection of the planes of symmetry 63 and 64. The struts can continuously converge over their lengths. Alternatively, the struts can have one or more converging sections.

Each inclined section 14A, 14B can comprise zero, one, two, or more horizontal cross members connecting the struts 44A and 44B together. The embodiment of FIG. 1 comprises a longer lower cross member 46A and a shorter upper cross member 48A interconnecting the struts 44A and 44B of the first inclined section 14A and a longer lower cross member 46B and a shorter upper cross member 48B interconnecting the struts 44A and 44B of the second inclined section 14B. The cross members 46, 48 can, for example, have a generally quadrilateral vertical cross-section with horizontal upper and lower surfaces and inclined side surfaces.

In embodiments designed for deeper waters, the GBS 10 can comprise cross ties 22 and/or 24 extending between and coupling the two inclined sections 14A and 14B. One set of cross ties 22A and 24A can interconnect the two struts 44A and another set of cross ties 22B and 24B can interconnect the two struts 44B. The cross ties 22, 24 can be similar in shape and elevation to the cross members 46, 48 when present.

The upper ends of the struts 14 can be connected together by the transition section 16. The transition section 16 can be at least partially frustoconical, have the general shape of a frustum, or have another shape. The transition section 16 can have a broader lower perimeter 50 having a first cross sectional area and can taper to a narrower upper perimeter 52 having a second cross section less than the first cross sectional area. The transition section 16 can comprise an axially extending open inner or central region 48 (FIG. 2). In the embodiment of FIG. 1, the transition section 16 has a square lower perimeter 50 and an octagonal upper perimeter 52, with polygonal side surfaces. In other embodiments, the transition section 16 can have circular upper and lower perimeters and a frustoconical side surface, or have other configurations.

The upper section 18 of the GBS 10 can extend upwardly from the upper perimeter, or top, 52 of the transition section 16. The upper section 18 can comprise an upright annular portion 54 and a flared or enlarged top portion 56. The upper section 18 can have open axially extending inner or central region 58 (FIG. 2). Central region 58 can be vertically oriented and can communicate with the open region 48 within the transition section 16. The upper section 18 can have a polygonal cross-section, as shown FIG. 1, a circular cross-section, or any other suitable shape. The flared portion 56 can have a narrower lower perimeter 60 with a smaller cross-sectional area than the upper surface 62 of the flared portion 56. The lower perimeter 60 is located at the intersection with the top of the annular upright portion 54. The flared portion 56 can increase in cross-section area toward a broad upper surface 62, which can support the topside structures 20.

The GBS can be sized such that, when supported on a seabed, the upright annular portion 54 of the upper section 18 is partially under water and partially above water. The upright annular portion 54 can have a smaller horizontal width relative to other portions the GBS 10 such that it receives less lateral force from waves and ice loads, which are generally concentrated near the upper surface of the sea. Various embodiments of the GBS 10 can be configured to be used in sea depths greater than 60 meters, such as depths ranging from about 60 meters to about 200 meters, though the GBS 10 can be configured to be used in other depths of water as well.

Figure 4:
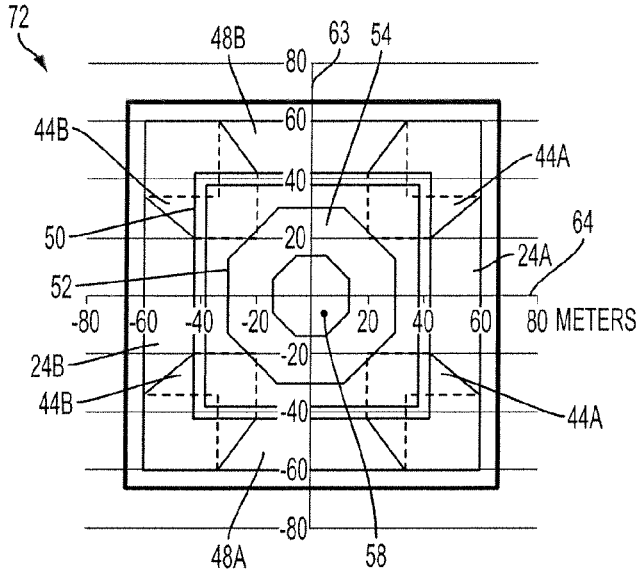
FIG. 4 shows a top plan view of a middle portion of an exemplary gravity base structure in the direction of arrows 4-4 of FIGS. 2A and 2B.

The dimensions shown in FIGS. 2-4 are merely exemplary and do not limit the disclosure in any way. These dimensions illustrate one exemplary embodiment, and other embodiments can have different dimensions.

FIGS. 2A and 2B illustrate one exemplary division of the GBS 10 into three assembly units 70, 72, and 74. A base unit 70 (shown in regular solid lines X) can comprise the two base sections 12A, 12B and lower portions of the two inclined sections 14A, 14B (e.g., lower portions of the struts 44A, 44B, lower cross members 46, and/or lower cross ties 22). In some embodiments, the lower cross members 46A, 46B can be included in the base unit 70. In addition, the base unit 70 can alternatively also comprise the lower cross ties 22A, 22B. In embodiments where the base unit 70 does not include lower cross ties 22A, 22B (such as for shallower waters), the base unit 70 can comprise two separate assembly base units 70A and 70B (as shown in FIG. 3). The middle unit 72 (shown in bolded dashed lines Y in FIGS. 2A and 2B and also shown in FIG. 4) can comprise upper portions of the inclined sections 14, the transition section 16, a lower portion of the upper section 18, and optionally the upper cross ties 24A, 24B. The top unit 74 (shown in solid bold lines Z) can comprise an upper portion of the upper section 18 and optionally the topside structures 20.

Each of the assembly units 70, 72, 74 can be constructed individually in a large dock. During assembly of the GBS, the base unit 70 can be positioned first floating partially submerged in a sea, then the middle unit 72 can be positioned over and coupled to the base unit 70, then the combined base unit 70 and middle unit 72 can be lowered in the water, then the top unit 74 can be positioned over and coupled to the middle unit 72. In some embodiments, the lower cross ties 22 can be coupled to the base unit 70 and the upper cross ties 24 can be coupled to the middle unit 72 before the top unit 74 is attached. In other embodiments, the GBS unit 10 can be divided into various other assembly units and/or sub-units and can be assembled in various other manners.

FIG. 3 shows a top plan view of the base units 70A, 70B of the embodiment of FIG. 2 without cross members 46 or cross ties 22. This view illustrates the open region 42 between the inner side surfaces 40 of the two base sections 12A and 12B. The inner most edges 41 of the inner side surfaces 40 can be parallel. This view also illustrates an exemplary footprint of the base sections 12 on the seabed, with the narrow intermediate portions 34 and the broader foot portion 30. The base units 70A, 70B can be symmetrical with each other about a vertical plane 64, while each can be symmetrical about a vertical plane 63. This view also shows lower portions of the four struts 44 slanting toward a central axis 66 of the structure, which is desirably vertical.

FIG. 4 shows a top plan view of the middle unit 72 of the embodiment of FIG. 2. This view illustrates the exemplary square cross sectional peripheral shape created by the four struts 44, the upper cross members 48A, 48B and the upper cross ties 24A, 24B at the bottom of the middle unit 72. This view also illustrates the octagonal cross-section of the exemplary upright annular portion 54. The middle portion 72 can be symmetrical about the vertical planes 63 and 64. In some embodiments, the middle portion 72 can also be symmetrical about two diagonal vertical planes (not shown) at 45° to the planes 63 and 64.

Figure 5:
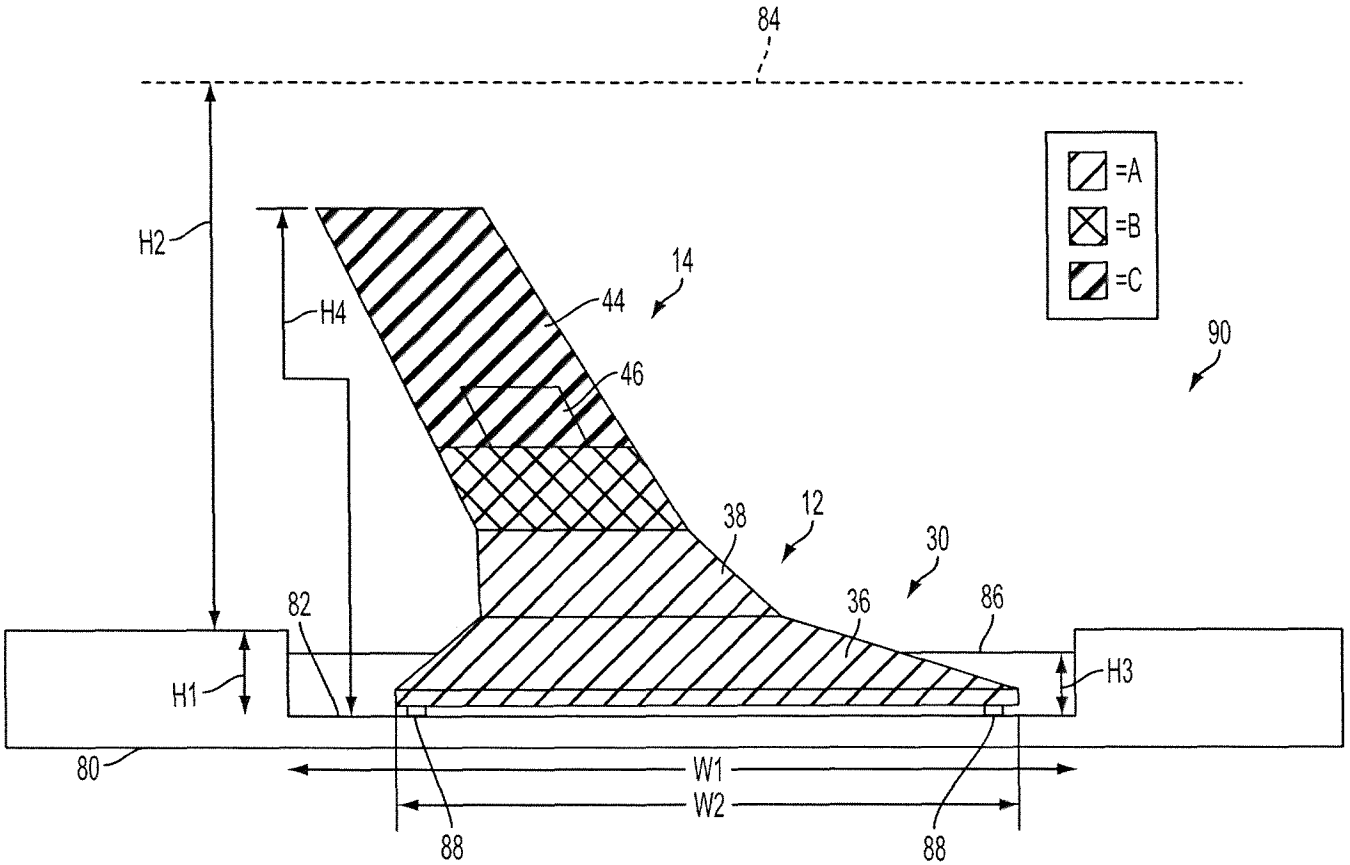
FIG. 5 shows an end profile view of a base unit of an exemplary gravity base structure in a dry dock environment.
Figure 6:
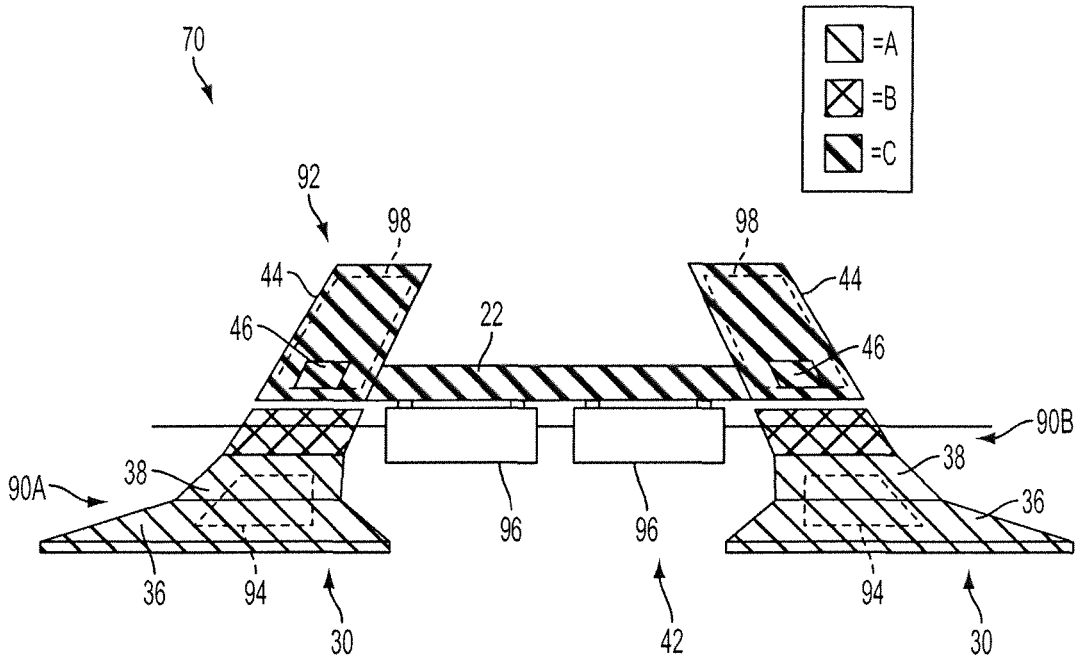
FIG. 6 shows an end profile view of an at-sea assembly of a portion of an exemplary gravity base structure comprising first and second base portions and a first upper section in position for assembly.

FIGS. 5 and 6 illustrate one exemplary construction approach of the base unit 70 shown in FIGS. 2A and 2B. In this approach, the base unit 70 is assembled from two base portions 90A and 90B and a third portion 92 that connects the base portions 90A, 90B. As shown in FIG. 5, in some embodiments, the two base portions 90 can be constructed individually in a dry dock 80. FIG. 5 shows a cross-sectional end view of one of the base portions 90 as constructed in dry dock 80. In some embodiments, the base portions 90 are extremely large and require very large dry docks. One very large dry dock 80 is illustrated. The dry dock 80 can comprise a floor 82 with a width W1 of about 131 meters and a lift 84, such as a goliath lift, which can have a maximum lifting height H2 of about 91 meters above the floor 82. The dock 80 can have a depth H1 of about 14.5 meters, which can be partially filled with water or other liquids 86, such as to a height H3 of about 10 meters, in order to help support and construct the base portions 90. The bottom surfaces of the base portions 90 can be spaced above the floor 82, such as via blocks 88, about 1.8 meters. Using such a large dry dock 80, each entire base portion 90 can be constructed at one time, and then moved as a single unit out of the dry dock for assembly to the base portion and the third portion 92 at sea.

In some embodiments, the base portions 90 can include the parts marked in FIG. 5 as A and B, and the part marked as C can be constructed with the third portion 92 (as shown in FIG. 6). Base portions comprising only parts A and B can comprise the portion of FIG. 1 shown below the dashed lines 1. In other embodiments, given a large enough dry dock, all three parts A, B and C shown in FIG. 5 can be constructed at once with the base portion 90, which can rise to a height H4 of about 85 meters above the floor 82. Such a base portion with parts A, B, and C can comprise the portion of FIG. 1 shown below the dashed lines 2. Two base portions comprising parts A, B and C can then be coupled together with the lower cross ties 22 at sea to form the base unit 70.

Importantly, the base portions 90 have a base length L (see FIG. 1) that is much greater than its base width (W2 shown in FIG. 5), and the dry dock 80 also desirably has sufficient length. The open region 42 between the two base sections 12A, 12B allows for the separate construction of each of the two discrete base portions 90 in their entirety in a single dry dock, one after another, such that they can later be assembled with other components at sea to form the GBS 10. This constructability would not be possible for a GBS having a base structure that exceeds the width of the dry dock.

As shown in FIG. 6, in some embodiments, the base unit 70 can be constructed in three parts. The two base portions 90A and 90B can comprise the portions of the GBS below the lower cross members 46 and the lower cross ties 22, which includes the parts marked as A and B in FIGS. 5 and 6. The third portion 92 can comprise the lower cross members 46A, 46B, the lower cross ties 22A, 22B, and intermediate portions of the four struts 44 up to the bottom of the upper cross members 48A, 48B and upper cross ties 24A, 24B. To assemble the three portions 90A, 90B and 92, the portions 90A and 90B can first be positioned in the floating arrangement shown in FIG. 6 at sea. To reduce the buoyancy of the portions 90A and 90B, enclosed internal regions in the portions 90A and 90B, such as those shown as 94 in FIG. 6, can be flooded with seawater, causing them to float lower in the water. Once they are floating at a desired level and proper lateral relation to one another, the third portion 92 can be transported over the top of them. As shown in FIG. 6, barges 96 can be used to positioned the third portion 92. Once over the top of the portions 90A and 90B, the third portion 92 can be lowered into contact with the tops of the portions 90A and 90B and the three portions can be coupled together (e.g., welded) to form the base unit 70, as shown in FIGS. 2A and 2B. In this embodiment, the base unit 70 includes the lower cross ties 22, whereas in the embodiment shown in FIG. 3, the two base units 70A and 70B can be constructed without the lower cross ties 22, and the lower cross ties 22 can optionally be added at a later time, or not at all.

Once the three portions 90A, 90B and 92 shown in FIG. 6 are joined together to form the base unit 70, the entire base unit 70 can be lowered in the water by further flooding the enclosed internal regions 94 and/or flooding enclosed internal regions in the third portion 92, such as the regions 98 shown in FIG. 6. Once the base unit 70 has been lowered to a desirable level, the separately constructed middle unit 72 can be positioned over the top of the third portion 92 and coupled (e.g., welded) to the base unit 70.

In the embodiment shown in FIGS. 3-5, the two individual base units 70A and 70B can likewise be lowered in the water by flooding internal floatation chambers, and, with the base units 70A and 70B properly spaced and aligned, the middle unit 72 can be positioned above the base units and coupled to them.

Once the middle unit 72 is coupled to the base unit 70, the structure can be further lower in the water by flooding one or more internal floatation chambers in the base unit 70 and/or the middle unit 72, and the top unit 74 can be positioned above the middle unit 72 can coupled together. The illustrated top unit 74 desirably has a positive hydrodynamic stability in an upright orientation such that it naturally floats with the top surface 62 above water, even with heavy facilities pre-coupled to the top surface.

The coupling together of the base unit 70, the middle unit 72, and the top unit 74 can be performed at any location with sufficient water depth, be it just off shore from the dry dock 80 where the units are constructed, or at a drilling site in an arctic sea. Because the GBS 10 comprises an open structure with large open regions between the base sections 12 and the inclined section 14, the entire assembled GBS 10 can be transported (towed) in water with reduced drag. The assembled GBS 10 is preferably towed in the water in the length direction L (see FIG. 1) such that two foot portions 30A or the two foot portion 30B are leading. When towed in this orientation, the base sections 12 and the inclined sections 14 have a minimal drag profile and the large open region 42 is aligned with the direction of travel, reducing hydrodynamic drag. In addition, the chamfered base sections 12 can reduce hydrodynamic drag as the GBS moves through the sea. Alternatively, the individual assembly units 70, 72, 74 can be separately towed to the set-down location and then assembled.

The overall configuration of the GBS has a very favorable hydrodynamic stability. In a desirable form, the pyramidal shape with broader, heavier base sections and narrower, lighter upper section contribute to the stability. As such, the GBS can be naturally stable in the upright position when afloat in water. In addition, the open structure of the GBS results in a reduced weight relative to a conventional GBS designed for the same water depth. The reduced overall weight, reduced drag, and natural hydrodynamic stability can make the GBS easier to transport in its fully assembled form across long distances in water, such as from near a dry dock to an arctic drilling location.

Once the assembled GBS 10 is at a desired set-down location, the entire GBS 10 can be lowered onto the seabed by further flooding internal floatation chambers with sea water until the bottom surfaces of the base sections 12 come into contact with the sea floor. The sea floor can be pre-conditioned prior to set-down, such as by leveling the surface, removing unstable material, adding material, etc. Desirably, the set-down location has a level sea floor such that the entire lower surfaces of the base sections 12 are supported by the sea floor. One advantage of the widely spaced base sections is that it reduces the overall footprint of the GBS on the seabed and thus reduces the amount of seabed preparation needed prior to set-down. In addition, the underside of the base sections 12 can be reinforced to withstand the pressures exerted by uneven seabed conditions. In some embodiments, a foundation skirt can be provided on or adjacent to the underside of the base section 12 to improve the stability of the foundations.

After the GBS is set down on the sea floor, the upper surface level of the sea is, under normal conditions, between the top of the transition section 52 and the top of the upright annular section 54, such that the upright annular section 54 protrudes through the surface of the water. Due to the relatively narrow width of the upright annular section 54, it can limit the magnitude of lateral forces imparted on the GBS 10 from wave action and from ice formations at the surface of the sea. In addition, the open structure of the base sections 12 and the inclined sections 14 can allow water currents to pass through the GBS with reduced resistance, particularly in the length direction L of the base sections 12. These features can reduce the total lateral load imparted on the GBS 10 compared to traditional GBS designs. The GBS can be oriented with the length direction oriented toward prevailing water currents to reduce lateral forces.

The widely spaced base portions 12 prevent the GBS 10 from overturning over due to lateral loads. In addition, the lateral frictional forces between the base sections 12 and the sea floor are sufficient to prevent the lateral sliding of the GBS along the sea floor. Nevertheless, in some embodiments, although less desirable, the GBS 10 can be further secured to the sea floor with piles, anchors, or other mechanisms. The GBS 10 can be configured to be used in deep waters with depths up to about 200 meters. One exemplary embodiment can be configured to be used in water depths of at least 150 meters, such as a range of water depths from about 150 meters to about 200 meters, while other exemplary embodiments can be configured to be used in other water depth ranges. The range of water depths a particular embodiment is designed for can be related to the vertical height of the upright annular portion 54.

Because the GBS is at least partially submerged in water when in use, the weight of the GBS can partially be supported by the water and partially be supported by the seabed. The portion supported by the seabed can be referred to as on-bottom weight. In the described embodiments, the two base sections 12 are configured to transfer substantially all of the on-bottom weight of the GBS to the seabed.

Figure 7A:
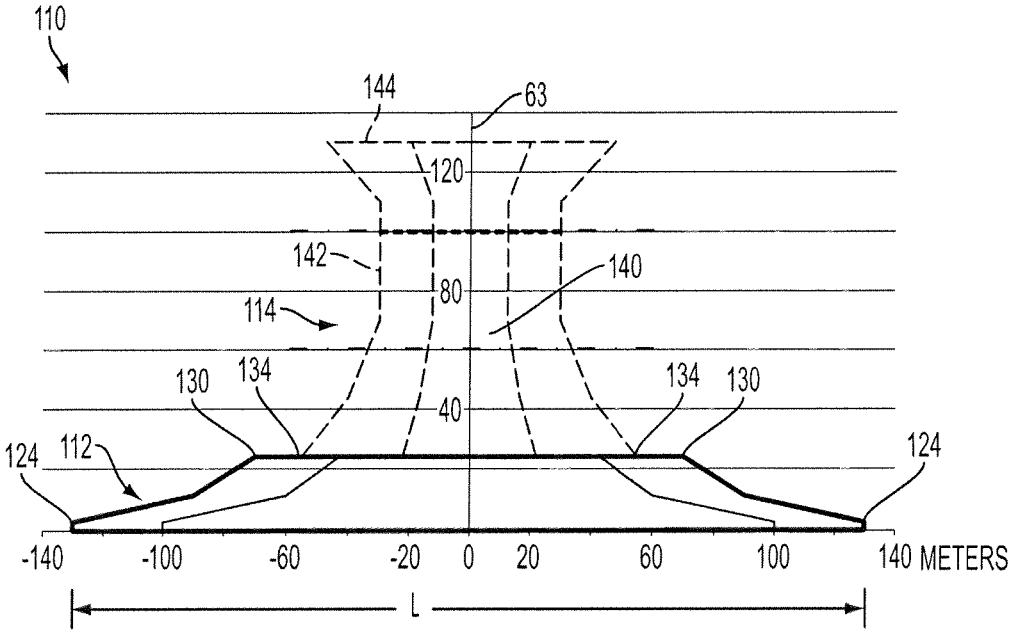
FIG. 7A shows a side profile view of an exemplary gravity base structure for shallower waters.
Figure 7B:
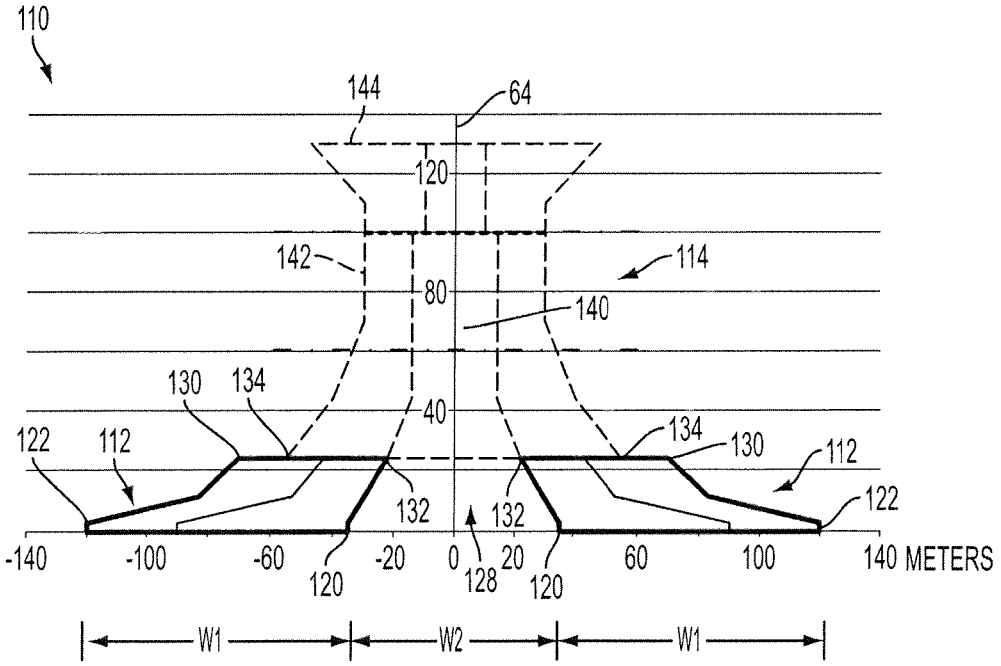
FIG. 7B shows a front end profile view of the gravity base structure of FIG. 7A.
Figure 8:
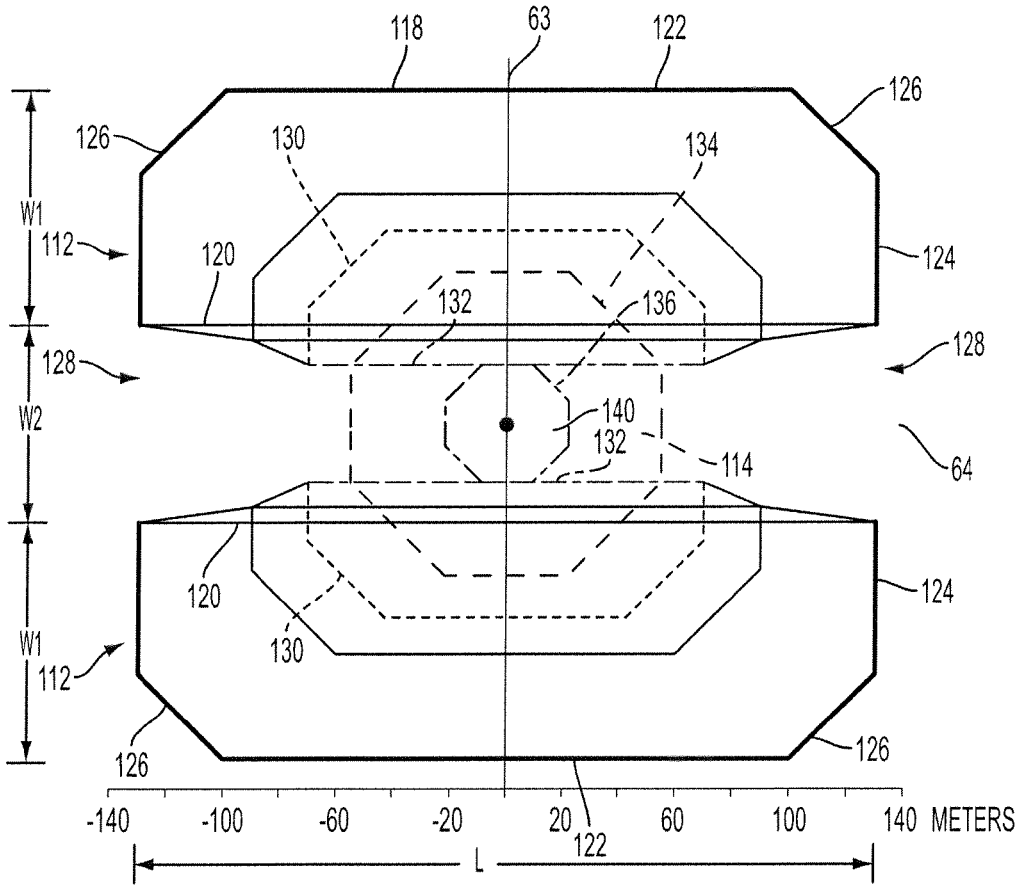
FIG. 8 shows a top plan view of a lower portion of the gravity base structure of FIGS. 7A and 7B.

FIGS. 7 and 8 show another embodiment of a GBS 110 that is configured to be used in water depths down to about 60 meters. One exemplary embodiment of the GBS 110 can be configured to be used in a range of water depths from about 60 meters to about 100 meters, while other exemplary embodiments can be configured to be used in other ranges. The GBS 110 comprises two spaced apart base sections 112 and an upper section 114 extending upwardly from the base sections 112. FIGS. 7A and 7B shown cross-sectional side and end views, respectively, of the GBS 110. FIG. 8 is a partial plan view of the GBS 110 showing outlines of the two base sections 112 at different heights and a lower profile of the upper section 114.

The base sections 112 can have a generally rectangular lower footprint 118 with generally parallel inner edges 120 and outer edges 122, generally parallel end edges 124, and diagonal or chamfered outer corner edges 126. Each footprint 118 can have a longitudinal length L, which can be about 250 meters, and a width W1, which can be about 85 meters. An open region 128 between the two base sections 112 can have width W2, which can be about 70 meters, and can extend the entire length L between the base sections 112. The base sections 112 can taper (continuously or partially) to an upper perimeter 130. An inner edge 132 of the upper perimeter 130 can be inward of the inner edge 120 of the footprint 118 such that the base sections 112 slant inwardly toward each other.

The upper section 114 can comprise an upright annular body with a variable horizontal cross-sectional profile. The upper section 114 can comprises a lower outer perimeter 134, which can have an octagonal shape as shown in FIG. 8, or another shape. The outer perimeter 134 can overlap a portion of the upper surface of the base sections 112 within the upper perimeter 130 and can intersect the inner edges 132. The upper section 114 can further comprise a lower inner perimeter 136 within the lower outer perimeter 134. The lower inner perimeter 136 is positioned over the open region 128 and can share lateral edges with the inner edges 132 of the bases sections 112. The upper section 114 can define an open inner region 140 that extends axially or vertically entirely through the upper section 114 and can have a variable cross-sectional area. The upper section 114 can taper in cross-sectional area moving upwardly from the bass section 112 to a narrowest vertical portion 142 and then increase in horizontal cross-sectional area moving upwardly from the vertical portion 142 to an upper surface 144.

The GBS 110 can be constructed and assembled in a similar manner as the GBS 110. For example, the base sections can be constructed individually and the upper section can be constructed in one or two parts that are assembled at sea.

The dimensions shown in FIGS. 7 and 8 are merely exemplary and do not limit the disclosure in any way. These dimensions illustrate one exemplary embodiment, and other embodiments can have different dimensions.

The structural components of the GBS embodiments disclosed herein can comprise any sufficiently strong, rigid material or materials, such as steel. In some embodiments, any of the lower components of the GBS, such as the base sections 12, can comprise concrete.

In some of the embodiments described herein, the first base section can comprise a first point at one end and a second point at the opposite end, the second base section can comprise a third point at one end and a fourth point at the opposite end, and the first, second, third, and fourth points define the vertices of a horizontal quadrilateral area, such that all portions of the GBS with greater elevation than the quadrilateral area are positioned directly above the quadrilateral area. For example, in the embodiment 10 of FIG. 1, the entire first and second inclined sections, the entire transition section, and the entire upper section and topsides are positioned directly above an area defined by the four foot portions 30.

In some of the embodiments described herein, any one or more of the various components of the GBS can comprise internal chambers that can be used to temporarily or permanently store liquids, such as water, hydrocarbons, air, and mixtures thereof. Desirably, all or most of the major structural components can comprise internal chambers that can be selectively filled with liquid to sink or raise that component and/or assemblies comprising that component. In some embodiments, internal chambers used for storing hydrocarbons can comprise double-skinned walls to reduce the risk of spills. Furthermore, any of the internal chambers of the GBS can comprise solid ballast.

In preferred embodiments, certain internal chambers are dedicated for storing hydrocarbons while other internal chambers, i.e., floatation chambers, are dedicated for storing water, such that hydrocarbons are not mixed with water. In such embodiments, the chambers that are filled with water are designed to remain filled with water while the GBS is positioned at a seabed location, in order to maintain sufficient gravitational interaction with the seabed, and the water is only removed in order to lift and move the GBS to another location. In these embodiments, the chambers for storing hydrocarbons can be selectively filled and emptied as desired while the GBS is at a location, and when they are not full of hydrocarbons, air or another gas can be used to fill them. In this way, the hydrocarbons do not mix with sea water. These embodiments can maintain sufficient overall density even when the hydrocarbon chambers are filled with air or other gasses.

In other embodiments, the same chambers can be used to store both water and hydrocarbons in a variable proportion such that the chambers are always filled with water and/or hydrocarbons. As hydrocarbons are added to the chambers, portions of the water in the chambers can be released into the sea, and as hydrocarbons are removed from the chambers, water can be added to the chambers. In these embodiments, the hydrocarbons can mix with the water, requiring that any water removed from the chambers can need to be cleaned prior to being released to the sea. Such embodiments can be made smaller and/or with less volume of internal chambers since all of the chambers are always full of a liquid, whereas embodiments with dedicated water and hydrocarbon chambers require a greater total chamber volume and additional ballast to compensate for the additional buoyancy.

The upper section 18 of the GBS 10 and the upper section 114 of the GBS 110 can comprise an inner open region through which drilling equipment passes from the upper platform to the seabed. This inner open region can be open at the upper and lower ends such that the sea water level within the open inner region naturally adjusts to the same height as the sea water surrounding the upper section. This inner region can be referred to as a "moon pool" and the surrounding upright annular structure can be referred to as a "caisson." In addition to structurally supporting the topside structures, the caisson can isolate the drilling equipment from waves and ice formations at the surface of the sea. Such ice formations extend several meters below sea level and thus the caisson desirably extends at least this far below sea level in a desirable embodiment.

The GBS embodiments disclosed herein can be used for various purposes. Some embodiments can be used for exploratory drilling wherein the GBS is moved to various locations to explore for desirable condition. Such embodiments can be configured to support exploratory drilling structures and equipment on the topsides. Other embodiments can be used in more permanent hydrocarbon production operations, wherein the GBS may stay at one location for a long period of time, such as several years, while hydrocarbons are extracted and processed. Some embodiments can be used for both exploratory purposes and production purposes. For exploratory operations, it can be desirable for the GBS to be functional in as great a range of water depths as possible. Accordingly, it can be desirable for the caisson portions to have a longer vertical height, while maintaining structural stability, such that the GBS can be used in a greater range of water depths. When used as a substructure for a permanent production facility, which can weigh up to 120,000 tonnes, the GBS can have a broader, more robust upper portion as production facilities are typically much larger and heavier than exploratory drilling rigs. In any case, the upright annular section can be configured to support substantially all of the weight of whatever hydrocarbon extraction superstructure is positioned on top of the upright annular section.

The illustrated embodiments can be used on seabeds with cohesive soils having an undrained shear strength lower than 30 kPa and larger embodiments (such as in FIG. 1 with lower and upper cross ties 22, 24) can withstand multi-year ice loads greater than 660 MN. Some of these larger embodiments can have an overall weight of less than 280,000 tonnes, not including the topside structures, due to the open structure.

General Considerations

For purposes of this description, certain aspects, advantages, and novel features of the embodiments of this disclosure are described herein. The disclosed apparatuses, systems, and methods should not be construed as limiting in any way. Instead, the present disclosure is directed toward all novel and nonobvious features and aspects of the various disclosed embodiments, alone and in various combinations and sub-combinations with one another. The disclosed embodiments are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "determine" and "provide" to describe the disclosed methods. These terms are high-level abstractions of the actual operations that are performed. The actual operations that correspond to these terms may vary depending on the particular implementation and are readily discernible by one of ordinary skill in the art.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C" or "A, B and C."

As used herein, the term "coupled" generally means mechanically, chemically, magnetically or otherwise physically coupled or linked and does not exclude the presence of intermediate elements between the coupled items, unless otherwise described herein.

In view of the many possible embodiments to which the principles of the disclosed invention may be applied, it should be recognized that the illustrated embodiments are only desirable examples and should not be taken as limiting the scope of the disclosure. Rather, the scope of the disclosure is defined by the following claims. We therefore claim as our invention all that comes within the scope of these claims.

I claim:

1. A gravity base structure comprising:

a first elongated base section comprising inner and outer sidewall portions, first and second end portions, an upper surface, and a lower support surface configured to be supported by a floor of a body of water;

a second elongated base section comprising inner and outer sidewall portions, first and second end portions, an upper surface, and a lower surface configured to be supported by the floor of the body of water, the first and second base sections being separated by an open region between the inner sidewall portions of the first and second base sections, the open region extending the entire length of the first and second base sections, the first and second base sections being configured to transfer substantially all of the on-bottom weight of the structure to the floor when the structure is supported by the floor;

an upright annular section positioned above the open region and configured to extend at least partially above an upper surface of the body of water, the upright annular section comprising an upwardly extending opening through the upright annular section;

a first inclined section coupled to the first base section and coupled to the upright annular section;

a second inclined section coupled to the second base section and coupled to the upright annular section; and wherein at least portions of the first and second inclined sections converge toward each other moving from the base sections toward the upright annular section.

2. The gravity base structure of claim 1, wherein the depth of the body of water is greater than 150 meters.

3. The gravity base structure of claim 1, wherein each of the first and second base sections comprise a footprint area configured to contact the floor, the footprint areas each being greater than the maximum horizontal cross-sectional area of the upright annular section.

4. The gravity base structure of claim 1, wherein the first and second base sections each comprise an internal floatation chamber such that the first and second base sections float when the chambers are not filled with water and filling the chambers causes the first and second base sections to sink.

5. The gravity base structure of claim 1, wherein the first and second inclined sections each comprise first and second inclined struts, and at least portions of the first and second inclined struts converge toward each other moving upwardly.

6. The gravity base structure of claim 5, wherein the first and second inclined sections each further comprise at least one horizontal cross member positioned below the upright annular section and above the respective base section and interconnecting the first and second struts.

7. The gravity base structure of claim 5, wherein the first and second inclined struts each continuously decrease in horizontal cross-sectional area moving from the respective base section toward the upright annular section.

8. The gravity base structure of claim 1, wherein the structure has no cross-members extending between the first and second base sections such that the first and second base sections are completely separated from one another in the area between the first and second base sections.

9. The gravity base structure of claim 1, wherein the upright annular section is configured to support substantially all of the weight of a hydrocarbon extraction superstructure positioned on top of the upright annular section.

10. The gravity base structure of claim 1, wherein each of the first and second base sections comprise an intermediate portion positioned between the first and second end portions, the intermediate portion having a narrower width than the widths of the first and second end portions.

11. The gravity base structure of claim 1, wherein the first base section comprises a first point and a second point; the second base structure comprises a third point and a fourth point; the first, second, third, and fourth points define the vertices of a horizontal quadrilateral area; and the entire upright annular section, the entire first inclined section, and the entire second inclined section are positioned directly above the quadrilateral area.

12. The gravity base structure of claim 1, wherein at least a portion of each of the first and second base sections decreases in horizontal cross-sectional area moving upwardly.

13. The gravity base structure of claim 1, wherein the upright annular section comprises a lower portion configured to be below the surface of the water, an upper portion configured to be above the surface of the water, and an intermediate portion between the lower and upper portions, and the horizontal cross-sectional area of the intermediate portion is less than the horizontal cross-sectional area of the upper portion and less than the horizontal cross-sectional area of the lower portion; and wherein the upper portion tapers moving downwardly toward the intermediate portion.

14. The gravity base structure of claim 1, further comprising a frustum section positioned between the inclined sections and the upright annular section.

15. The gravity base structure of claim 1, wherein the first base section comprises a first footprint area configured to contact the floor and the second base sections comprises a second footprint area configured to contact the floor, and the area of the open region between the first and second footprint areas is greater than 50% of the combined area of the first and second footprint areas.

16. The gravity base structure of claim 1, wherein the gravity base structure comprises a lower unit that includes:

the elongated first base section; and the elongated second base section the first and second base sections each comprising at least one floatation chamber such that, when the lower unit is separate from upper portions of the gravity base structure, the first and second base sections float when the floatation chamber is not filled with water and filling the floatation chambers with water causes the first and second base sections to sink.

17. The gravity base structure of claim 16, wherein the first and second base sections are coupled together by an overhead cross tie such that an open region extends below the cross tie and between the first and second end portions along the entire length of the first and second base sections.

18. The gravity base structure of claim 16, the lower unit further comprising a third section coupling the first and second base sections together, the third section comprising four inclined corner struts and four horizontal members interconnecting the corner struts in a rectangular configuration, two of the corner struts being coupled to the first base section and the other two corner struts being coupled to the second base section.

19. The gravity base structure of claim 18, wherein the third section further comprises at least one floatation chamber such that, when the lower unit is separate from upper portions of the gravity base structure, the lower unit floats when the floatation chamber of the third section is not filled with water and filling the floatation chamber of the third section with water causes the lower unit to sink.

20. A gravity base structure comprising:

a first elongated base section comprising inner and outer sidewall portions, a first chamfered foot portion at one end, a second chamfered foot portion at the opposite end, an intermediate portion between the first and second foot portions having a narrower width than the widths of the first and second foot portions, an sloped upper surface, and a lower support surface configured to rest on a floor of a sea;

a second elongated base section comprising inner and outer sidewall portions, a first chamfered foot portion at one end, a second chamfered foot portion at the opposite end, an intermediate portion between the first and second foot portions having a narrower width than the widths of the first and second foot portions, an sloped upper surface, and a lower support surface configured to rest on the floor of the sea;

the first and second base sections being separated by an open region between the inner sidewall portions of the first and second base sections, the open region extending the entire length of the first and second base sections, the first and second base sections being configured to transfer substantially all of the on-bottom weight of the structure to the floor when the structure is resting on the floor;

first and second inclined struts coupled to the first base section, the first and second inclined struts slanting toward each other and toward the second base section;

third and fourth inclined struts coupled to the second base section, the third and fourth inclined struts slanting toward each other and toward the first and second inclined struts;

first and second horizontal cross members coupling the first and second struts together, the first cross member being above the second cross member;

third and fourth horizontal cross members coupling the third and fourth struts together, the third cross member being above the fourth cross member;

first and second horizontal cross ties coupling the first and third struts together, the first cross tie being above the second cross tie;

third and fourth horizontal cross ties coupling the second and fourth struts together, the third cross tie being above the fourth cross tie;

a transition section comprising an upper end, a lower end coupled to top ends of the first, second, third and fourth inclined struts, and a vertical opening extending between the upper and lower ends; and an upright annular caisson section comprising a top end, a bottom end coupled to the upper end of the transition section, and a vertical opening extending between the top end and the bottom end and communicating with the vertical opening of the transition section, the caisson section configured to intersect an upper surface of the sea when the structure is resting on the floor of the sea, and configured to support substantially all of the weight of a hydrocarbon extraction superstructure positioned above the top end of the caisson section.

* * * * *